US005699077A

United States Patent [19]

Hosotani

[11] Patent Number: 5,699,077

[45] Date of Patent: Dec. 16, 1997

[54] SCREEN DISPLAY CIRCUIT

[75] Inventor: Osamu Hosotani, Itami, Japan

[73] Assignee: Mitsubishi Denki Kabushiki Kaisha, Tokyo, Japan

[21] Appl. No.: 457,253

[22] Filed: Jun. 1, 1995

[30] Foreign Application Priority Data

Dec. 9, 1994 [JP] Japan ..... 6-306411

[51] Int. Cl.[6] ..... G09G 5/00

[52] U.S. Cl. ..... 345/113; 345/141; 345/201

[58] Field of Search ..... 345/113, 114, 345/115, 116, 141, 192, 193, 194, 195, 201, 143; 348/589, 584, 585, 586

[56] References Cited

U.S. PATENT DOCUMENTS

| | | | |
|---|---|---|---|
| 4,496,976 | 1/1985 | Swanson et al. | 345/113 |
| 4,689,616 | 8/1987 | Goude et al. | 345/113 |
| 4,868,781 | 9/1989 | Kimura et al. | 345/113 |
| 4,924,299 | 5/1990 | Mizuno et al. | 345/113 |
| 4,996,598 | 2/1991 | Hara | 345/589 |
| 5,453,763 | 9/1995 | Nakagawa et al. | 345/192 |

*Primary Examiner*—Xiao Wu
*Attorney, Agent, or Firm*—Lowe, Price, LeBlanc & Becker

[57] ABSTRACT

A screen display circuit, comprising: a register 13 storing data designating a screen whereon a pattern is displayed, and a position of the pattern on the screen; a RAM 4 storing data designating the pattern; first and second buffers 15, 16 which temporarily stores and output addresses of the patterns to be displayed respectively on the first and second screens; a ROM 5 storing a plurality of font data; a switch 17 which connects the ROM 5 alternately to the first buffer 15 and the second buffer 16; and a mixing circuit 22 which composes dot data of the patterns to be displayed on the first and second screens outputted alternately from the ROM 5, whereby the first screen and the second screen, whereon dot patterns are respectively displayed, are composed and displayed on a display apparatus. As a result, hardwares can be reduced and a manufacturing cost can be reduced.

18 Claims, 11 Drawing Sheets

FIG. 11

| P2 | P1 | PRIORITY OF R′, G′, B′/R″, G″, B″ |
|---|---|---|
| 0 | 0 | OR COMPOSITION |
| 1 | 0 | R′, G′, B′ HAVE PRIORITY |
| 0 | 1 | R″, G″, B″ HAVE PRIORITY |
| 1 | 1 | INHIBITED |

SCREEN DISPLAY CIRCUIT

BACKGROUND OF THE INVENTION

1. Field of the Invention

The present invention relates to a screen display circuit used in an image display apparatus such as a television set, a video tape recorder and the like, and more particularly, to a screen display circuit which overlaps a plurality of screens whereon patterns such as characters, symbols and the like are respectively displayed on images to be displayed originally by the image display apparatus for display.

2. Description of the Relates Art

A recent image display apparatus such as a television set, a video tape recorder and the like, in many cases, is provided with a character display function peculiar to the apparatus for displaying operation information such as a selected channel, sound volume and so on, or time on a monitor screen by means of characters (including symbols). In order to fulfill such a character display function, a screen display circuit and the like are required for reading dot data of the characters to be displayed from a memory (usually a ROM) in which font data of the characters is stored in the form of dot data, and coloring it into a designated color so as to be displayed on the monitor screen at a suitable timing.

While, in the television broadcasting, such a new service is realized that, character code signals besides image signals are transmitted from a broadcasting station so as to overlap, for example, a character screen on the image signals for display. In this case, in the same way as the aforementioned character display function peculiar to the image display apparatus such as the television set or the video tape recorder, the image display circuit including the memory storing the font data is necessary. In other words, in order to fulfill the character display function peculiar to the image display apparatus and the character display function performed by the character code signal transmitted from the broadcasting station at the same time, two sets of circuits having the substantially same configuration are necessary.

A schematic diagram of FIG. 1A schematically shows the case where the above-mentioned display is made. Specifically, FIG. 1A shows the state where a channel number "CH5" selected at present by the character display function peculiar to the image display apparatus is displayed in characters perforated in white, and a character screen "HELLO" performed by the character code signal sent from the broadcasting station is displayed in a black character by OR composition.

FIG. 2 is a block diagram showing a conventional configuration of a screen display circuit for displaying the 2-group characters as above-mentioned at the same time. In the following, the configuration of the prior art is described.

In FIG. 2, numeral 10 designates a screen display circuit, a set of which is for displaying operation information of the image display apparatus itself or the time, and another set is for displaying characters, symbols and the like designated by a character code such as a character screen sent from the broadcasting station. The two screen display circuits 10 have the same internal configuration, respective internal components being designated by the same reference characters. The screen display circuits 10 comprise, a register 3, a RAM 4, a ROM 5, a timing circuit 6, a shift register 7 and a coloring circuit 8.

The reference numeral 1 designates a CPU which is connected to the internal components of both the screen display circuits 10 through a data bus 2. Characters 11R, 11G and 11B respectively designate OR gates, which output R, G and B signals 12 outputted from both the screen display circuits 10 after OR composition.

In the following, the configuration of both the screen display circuits 10 is described.

When the CPU 1 outputs the block number which is a unit of character display for one line on the display screen whereon the characters are to be displayed, the register 3 stores the block number temporarily and gives it to the RAM 4. When the CPU 1 outputs data designating the characters and colors to be displayed in the blocks (hereinafter, the data is referred to as the coloring data), the RAM 4 stores it. Data designating the character among the data stored in the RAM 4 is given to the ROM 5, and data designating the color is given to the coloring circuit 8.

The ROM 5 stores font data of the various characters in the form of dot data. When data designating a character is given to the ROM 5 from the RAM 4, specifically, data designating the address in which the font data is stored in the ROM 5 is given, the corresponding dot data is outputted to the shift register 7 in the form of parallel data.

Though omitted in the figure, a horizontal synchronizing signal, a vertical synchronizing signal of the image display apparatus and a clock signal for character display are inputted to the timing circuit 6, and the timing circuit 6 generates a timing signal for operating the screen display circuits 10 on the basis of these signals. The timing signal generated by the timing circuit 6 is given to the register 3, RAM 4 and shift register 7.

The shift register 7 outputs the dot data, which is outputted from the ROM 5 in the form of parallel data, to the coloring circuit 8 after converting it into serial data. The coloring circuit 8 outputs the R, G and B signals to respectively corresponding output terminals 9R, 9B and 9G by composing the coloring data outputted from the RAM 4 and the output data of the shift register 7.

The OR gates 11R, 11B and 11G display the 2-group R, G and B signals outputted from the output terminals 9R, 9B and 9G of both the screen display circuits 10 on a display screen, not shown, after OR composition.

The operation of such a conventional screen display circuit is as follows.

At first, when the CPU 1 outputs the block number designating a block whereon the character is to be displayed, data designating the character to be displayed therein and coloring data designating the color to the data bus 2, the register 3 stores the block number and the RAM 4 stores the data designating the character and the coloring data.

Since the timing signal generated in synchronism with the horizontal synchronizing signal, vertical synchronizing signal and the clock signal for character display is given to the register 3, RAM 4 and shift register 7 from the timing circuit 6, the RAM 4 outputs the data designating the character to be displayed to the ROM 5 and the coloring data to the coloring circuit 8, at the timing corresponding to the block number given from the register 3. Thereby, the dot data of the designated font is outputted from the ROM 5 in the form of parallel data and given to the coloring circuit 8 after being converted into the serial data by the shift register 7. In the coloring circuit 8, the coloring data given from the RAM 4 and the parallel font data given from the shift register 7 are composed, and the resulting R, G and B signals are outputted respectively to the output terminals 9R, 9B and 9G.

Since the above-mentioned operation is performed in both the screen display circuits 10, from its output terminals 9R, 9B and 9G, the R, G and B signals are outputted and displayed as the R, G and B signals 12, after OR composition by the OR gates 11R, 11B and 11G, on the display screen as shown in a schematic diagram of FIG. 1A.

Now, in the conventional screen display circuit as mentioned above, two sets of screen display circuits, one for character display function peculiar to the image display apparatus such as the television set and the video tape recorder, and another one for displaying the characters and symbols designated by the character code signal sent from the broadcasting station are required, thus it is not economical in circuit configuration and largely affecting the manufacturing cost. As particularly shown in the above-mentioned conventional configuration, in spite of a very large hardware capacity occupied by the ROMs storing the font data, substantially the same font data is stored in the two ROMs. A hardware capacity occupied by the RAMs is also large. Thus, the hardwares or the manufacturing cost can be cut by reducing the ROM and RAM.

SUMMARY OF THE INVENTION

The present invention has been devised in view of such circumstances, therefore, it is an object thereof to provide a screen display circuit capable of reducing hardwares and cutting manufacturing cost, by replacing two sets of screen display circuits required hitherto, one for character display function peculiar to an image display apparatus and another one for displaying characters and symbols designated by character code signals sent from a broadcasting station, with one set, and particularly, by adopting only one ROM for storing font data.

It is another object of the present invention to provide a screen display circuit, wherein the font data can display the character which is not prepared beforehand by composing two screens, so that the capacity of the ROM storing the font data is reduced, or conversely, the characters which can be displayed by the ROM of the same capacity are increased.

It is a further object of the present invention to provide a screen display circuit capable of displaying characters on a display apparatus other than a main display apparatus, when a plurality of display apparatus are provide.

It is still another object of the present invention to provide a screen display circuit capable of OR composing the characters displayed on a plurality of screens, or composing any of the characters according to priority.

The screen display circuit according to the present invention, comprises: display position storing means for storing data designating either the first screen or the second screen whereon the pattern to be displayed is displayed, and data designating the position of the pattern to be displayed on the designated screen; display pattern storing means for storing data designating the patterns to be displayed; first temporary storing means for temporarily storing and outputting the data designating the pattern to be displayed on the first screen among the data stored in the display pattern storing means; second temporary storing means for temporarily storing and outputting the data designating the pattern to be displayed on the second screen among the data stored in the display pattern storing means; dot data storing means for storing dot data of a plurality of patterns, and outputting the corresponding dot data when the data designating the pattern is given; switching means for connecting the dot data storing means alternately to the first temporary storing means and the second temporary storing means; and composing means for composing the dot data of the pattern to be displayed on the first screen and the dot data of the pattern to be displayed on the second screen which are outputted from the dot data storing means.

In the screen display circuit according to the present invention, the display pattern storing means, at the timing of displaying the display position stored in the display position storing means, outputs the data designating the pattern to be displayed on the first screen and stores it in the first temporary storing means, and outputs the data designating the pattern to be displayed on the second screen and stores it in the second temporary storing means, the switching means gives the data stored in the first temporary storing means and the data stored in the second temporary storing means alternately to said dot data storing means, the dot data storing means alternately outputs the dot data of the pattern corresponding to the data given from the first temporary storing means and the dot data of the pattern corresponding to the data given from the second temporary storing means, and the composing means composes the dot data outputted alternately from the dot data storing means.

Further, the screen display circuit according to the present invention comprises: first display position storing means for storing data designating the position, on the screen, of the pattern to be displayed on the first screen; second display position storing means for storing data designating the position, on the screen, of the pattern to be displayed on the second screen; first display pattern storing means for storing data designating the pattern to be displayed on the first screen; second display pattern storing means for storing data designating the pattern to be displayed on the second screen; dot data storing means for storing dot data of a plurality of patterns, and outputting the corresponding dot data when the data designating the pattern is given; switching means for connecting the dot data storing means alternately to the first display pattern storing means and the second display pattern storing means; and composing means for composing the dot data of the pattern to be displayed on the first screen and the dot data of the pattern to be displayed on the second screen which are outputted from the dot data storing means.

Also, in the screen display circuit according to the present invention, the first display pattern storing means, at the timing of displaying the display position stored in the display position storing means, outputs the data designating the pattern to be displayed on the first screen, the second display pattern storing means, at the timing of displaying the display position stored in the display position storing means, outputs the data designating the pattern to be displayed on the second screen, the switching means gives the data outputted from the first display pattern storing means and the data outputted from the second display pattern storing means alternately to the dot data storing means, the dot data storing means alternately outputs the dot data of the pattern corresponding to the data given from the first display pattern storing means and the dot data of the pattern corresponding to the data given from the second display pattern storing means, and the composing means composes the dot data outputted alternately from the dot data storing means.

Furthermore, the screen display circuit according to the present invention comprises: display position storing means for storing data designating the common display position, on the first screen and second screen, of the patterns to be displayed; display pattern storing means for storing data designating simultaneously, by one data, a first pattern to be displayed on the first screen and a second pattern to be displayed on the second screen; dot data storing means for storing dot data of a plurality of patterns, and outputting the corresponding dot data when the data designating the pattern is given; switching means for giving a portion designating the first pattern and a portion designating the second pattern of the data stored in the display pattern storing means alternately to the dot data storing means; and composing means for composing the dot data of the pattern to be displayed on the first screen and the dot data of the pattern to be displayed on the second screen which are outputted from the dot data storing means.

Furthermore, in the display circuit according to the invention, the display pattern storing means, at the timing of displaying the display position stored in the display position storing means, outputs data designating the pattern to be displayed, the switching means gives a portion designating the first pattern and a portion designating the second pattern among the data outputted from the display pattern storing means alternately to the dot data storing means, the dot data storing means alternately outputs the dot data of the pattern corresponding respectively to the data given alternately from the display pattern storing means, and the composing means composes the dot data outputted alternately from the dot data storing means.

Also, the screen display circuit according to the present invention is configured such that, the composing means includes, logical-summing means for obtaining the logical sum of data outputted alternately from the dot data storing means, selective outputting means for selectively outputting either of the two, and controlling means for functioning either the logical-summing means or the selective outputting means.

Also, in the screen display circuit according to the present invention, the composing means is capable of controlling to selectively output either of both data outputted alternately from the dot data storing means or logical sum of them.

Furthermore, the screen display circuit according to the present invention comprises means for outputting, by by-passing the composing means, at least one of data outputted alternately from the dot data storing means and inputted to the composing means.

Meanwhile, in the screen display circuit of the present invention, at least one of the data outputted alternately from the dot data storing means and inputted to the composing means can be outputted by bypassing the composing means and be displayed on the other display apparatus.

The above and further objects and features of the invention will more fully be apparent from the following detailed description with accompanying drawings.

BRIEF DESCRIPTION OF THE DRAWINGS

FIG. 11 is a table showing the relationship between output signals of a mixing circuit used in a first to third embodiments of a screen display circuit of the present invention and data values set in a 2-bit register.

DESCRIPTION OF THE PREFERRED EMBODIMENTS

Figure 1A:
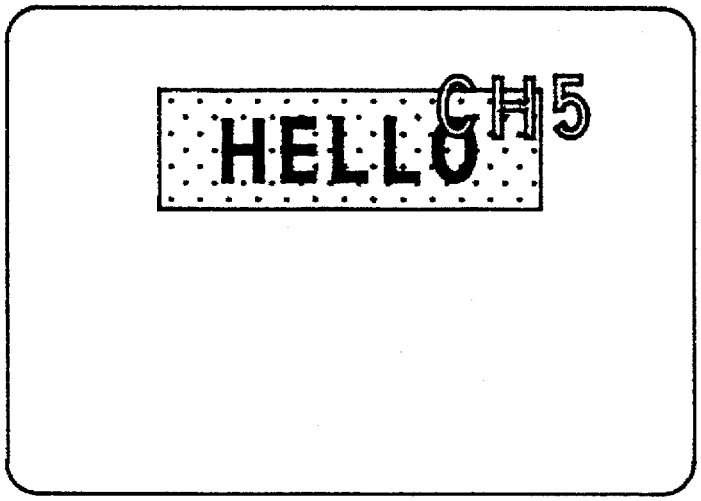
FIG. 1A and FIG. 1B are schematic diagrams showing examples of displaying state by a first and second embodiment of a screen display circuit of the present invention and a conventional screen display circuit.

In the following, the present invention is particularly described referring to the drawings showing its embodiments.

[First Embodiment]

At first, explanation will be given on a first embodiment whose configuration example is shown in a block diagram of FIG. 3. As shown in a schematic diagram of FIG. 4, 2-layer display screens (hereinafter, respectively referred to as a first layer L1 and a second layer L2) are outputted and characters can be displayed on any blocks on the respective layers L1 and L2.

Figure 3:
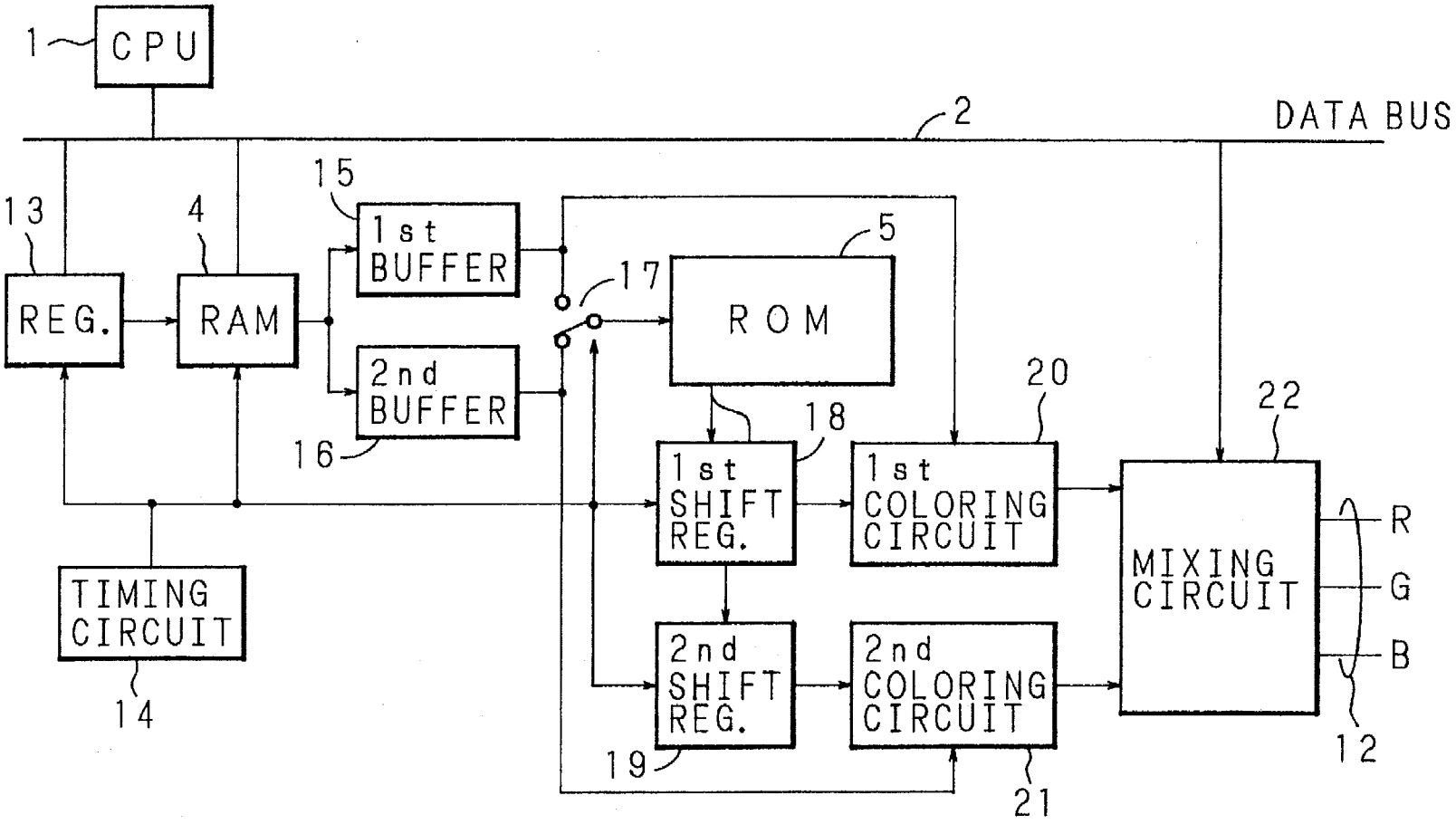
FIG. 3 is a block diagram showing a configuration example of a first embodiment of a screen display circuit according to the present invention.
Figure 4:
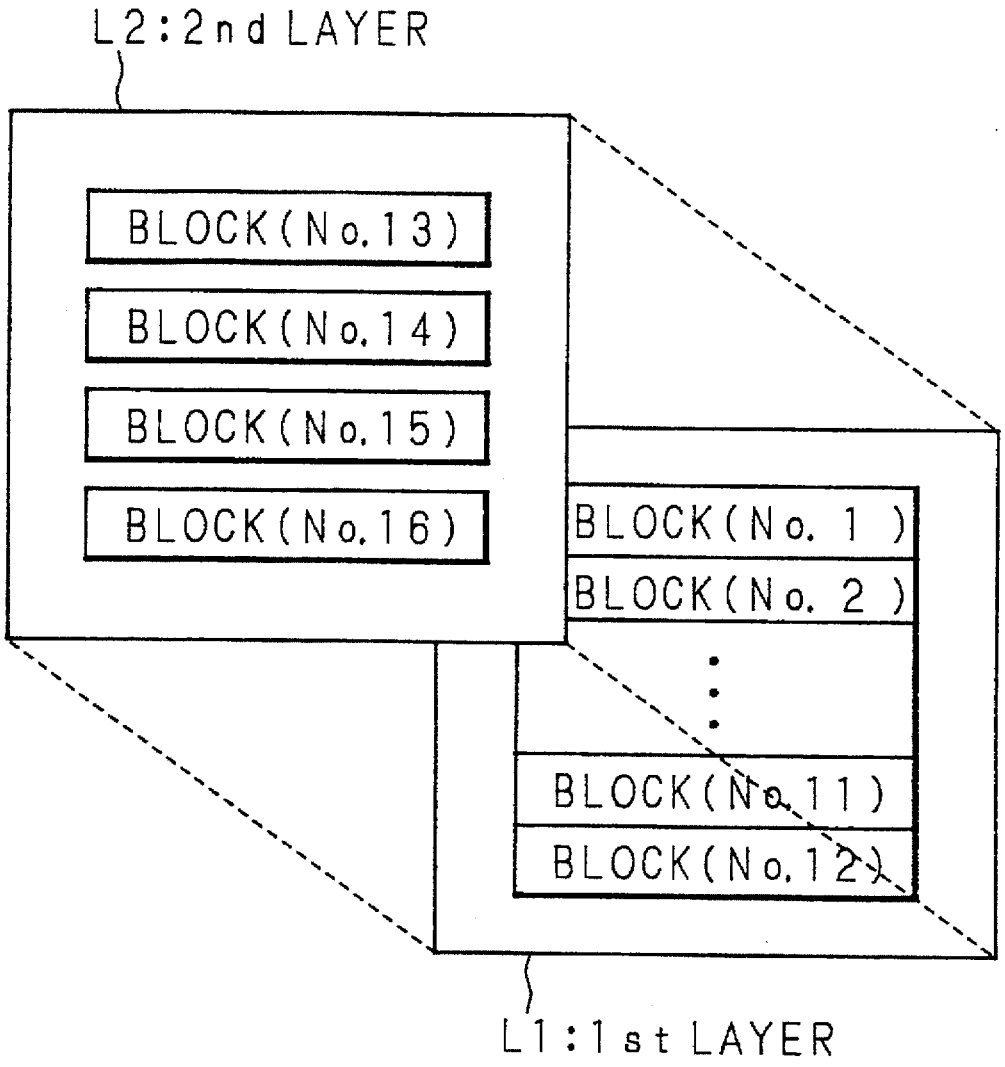
FIG. 4 is a schematic diagram showing 2-layer display screens (layers) displayed by a screen display circuit of the present invention.

In FIG. 3, numeral 1 designates a CPU which is connected to components of a screen display circuit of the present invention through a data bus 2.

Numeral 13 designates a register which functions as display position storing means. When the CPU 1 outputs the block number which is a unit of character display for one line on the display screen whereon the character is to be displayed, and data designating the first or second layer whereon the block is to be displayed, the register 13 stores the data temporarily.

Numeral 4 designated a RAM which functions as display pattern storing means and receives data held by the register 13. And when the CPU 1 outputs the data designating font data of the character to be displayed in the blocks, or data designating an storage address in a ROM 5 to be described later and its color (hereinafter, referred to as coloring data), the RAM 4 stores the data.

Numeral 15 designates a first buffer which functions as first temporary storing means. When data associated with the character to be displayed on the first layer L1 among the data stored in the above-mentioned RAM 4 is outputted, the first buffer 15 temporarily holds and outputs the data. Numeral 16 designates a second buffer which functions as second temporary storing means. When data associated with the character to be displayed on the second layer L2 among the data stored in the above-mentioned RAM 4 is outputted, the second buffer 16 temporarily holds and outputs the data. An address of font data in the data held by the first buffer 15 is given to the ROM 5 via a switch 17 functioning as switching means, and coloring data is given directly to a first coloring circuit 20. An address of font data in the data held by the second buffer 16 is given to the ROM 5 via the switch 17, and the coloring data is given directly to a second coloring circuit 21.

The ROM 5 functions as dot data storing means. That is, the ROM 5 stores the font data of various characters in the form of dot data. When the data designating the font data outputted from the RAM 4, correctly, the address storing the font data in the ROM 5 is given via the first buffer 15 and switch 17, the ROM 5 outputs the corresponding font dot data to a first shift register 18 in the form of parallel data. When the address in which the font data is stored is given via the second buffer 16 and switch 17, the ROM 5 also outputs the corresponding font dot data to a second shift register 19 in the form of parallel data.

The first shift register 18 converts the dot data of the character to be displayed on the first layer L1 given from the ROM 5 in the form of parallel data into serial data, and the second shift register 19 converts the dot data of the character to be displayed on the second layer L2 given from the ROM 5 in the form of parallel data into serial data.

Numeral 14 designates a timing circuit to which, though omitted in the figure, a horizontal synchronizing signal, a vertical synchronizing signal of an image display apparatus and a clock signal for character display are inputted. The timing circuit 14 generates a timing signal for operating the screen display circuit of the present invention according to these signals. The timing signal generated by the timing circuit 14 is given to the aforementioned register 13, RAM 4, switch 17 and first and second shift registers 18 and 19.

Numeral 20 designates a first coloring circuit, and numeral 21 designates a second coloring circuit. To the coloring circuits 20 and 21, coloring data outputted from the RAM 4 and held respectively in the first buffer 15 and second buffer 16 as aforementioned is also given, and by composing the data outputted from the shift registers 18 and 19 and the coloring data, R, G and B signals to be displayed on the first layer L1 and R, G and B signals to be displayed on the second layer L2 are outputted respectively.

Numeral 22 designates a mixing circuit which functions as composing means, and outputs the R, G and B signals 12 obtained by OR composing the R, G and B signals outputted from the coloring circuits 20 and 21 according to data given from the CPU 1, or the R, G and B signals 12 composed in such a manner to display any one according to priority.

The operation of such screen display circuit of the present invention is as follows.

When the CPU 1 at first outputs the block number designating a block whereon the character is to be displayed, the layer number whereby the block is to be displayed, font data (address) of the character to be displayed inside the block and data designating the color (coloring data) to the data bus 2, the register 13 stores the block number and layer number, and the RAM 4 stores the address of font data and the coloring data.

Since the timing signal generated in synchronism with the horizontal synchronizing signal, vertical synchronizing signal and clock signal for character display is given to the register 13, RAM 4, switch 17 and shift registers 18 and 19 from the timing circuit 6, the RAM 4 outputs the address of font data of the character to be displayed on the first layer L1 to the first buffer 15 and the coloring data to the first coloring circuit 20, at the timing corresponding to the block number given from the register 13, and outputs the address of font data of the character to be displayed on the second layer L2 to the second buffer 16 and the coloring data to the second coloring circuit 21, at the timing corresponding to the block number given from the register 13.

Though the address of font data of the characters to be displayed on the first and second layers L1 and L2 outputted from the RAM 4 are outputted respectively from the buffers 15 and 16, these data are alternately given to the ROM 5 via the switch 17 whose switching operation is controlled by the timing signal generated by the timing circuit 14. By giving the address of font data via the switch 17, the ROM 5 outputs the corresponding dot data in the form of parallel data.

By controlling of the timing circuit 14, the first shift register 18 temporarily holds the dot data to be displayed on the first layer L1 outputted from the ROM 5 in the form of parallel data, and the second shift register 19 temporarily holds the dot data to be displayed on the second layer L2 outputted from the ROM 5 in the form of parallel data. The timing of holding the data outputted from the ROM 5 by the shift registers 18 and 19 is controlled by the timing signal generated by the timing circuit 14.

The data held by the shift registers 18 and 19 is controlled by the timing signal generated by the timing circuit 14, and simultaneously converted into serial data so as to be outputted respectively to the first coloring circuit 20 and the second coloring circuit 21. In both the coloring circuits 20 and 21, since the coloring data outputted from the RAM 4 and held respectively in the buffers 15 and 16 are given, they are composed together with the dot data outputted from the shift registers 18 and 19 and the resulting R, G and B signals are outputted to the mixing circuit 22. To the mixing circuit 22, data designating whether to display the first and second layers L1 and L2 by OR composition or to display either of the two according to priority is given. Thus, the mixing circuit 22 OR composes the R, G and B signals outputted respectively from the coloring circuits 20 and 21, or composes either of the signals according to priority and outputs the R, G and B signals 12.

As mentioned above, in the first embodiment of the screen display circuit of the present invention, since each number of the ROM which requires the largest hardware quantity and the RAM which requires the second largest hardware quantity can be reduced respectively to one, the hardware quantity, as a whole, can be reduced considerably.

[Second Embodiment]

Figure 5:
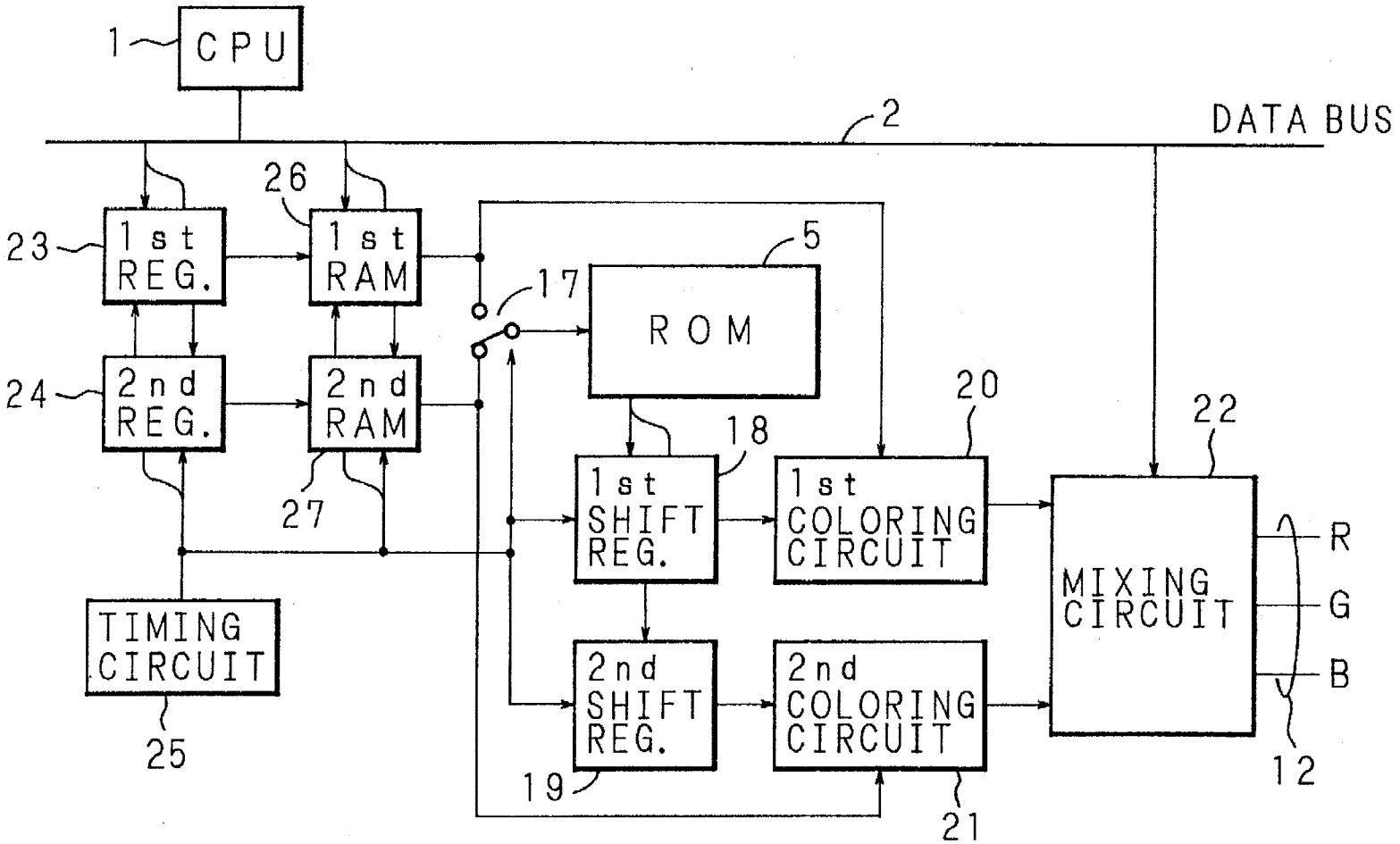
FIG. 5 is a block diagram showing a configuration example of a second embodiment of a screen display circuit according to the present invention.

Next, a second embodiment of the screen display circuit of the present invention is described with reference to a block diagram of FIG. 5 showing its configuration. The difference between the first embodiment and the second embodiment shown in the block diagram of FIG. 5 is that, the register designated by numeral 13 and the RAM designated by numeral 4 in the first embodiment are respectively provided by two sets in the second embodiment. The first and second buffers 15 and 16 provided in the first embodiment are not provided in the second embodiment.

In FIG. 5, numeral 23 designates a first register which functions as first display position storing means, and numeral 24 designates a second register which functions as second display position storing means. When the block number of the first layer L1 as the block number to be displayed is outputted from the CPU 1, the first register 23 stores this block number. Also, when the block number of the second layer L2 as the block number to be displayed is outputted from the CPU 1, the second register 24 stores this block number.

Numeral 26 designates a first RAM which functions as first display pattern storing means, and numeral 27 designates a second RAM which functions as second display pattern storing means. The first RAM 26 stores the address of font data and its coloring data of the character to be displayed in a block of the first layer L1 when they are outputted from the CPU 1. The second RAM 27 stores the address of font data and its coloring data of the character to be displayed in a block of the second layer L2 when they are outputted from the CPU 1.

The address of font data in the data stored in the first RAM 26 is outputted to the switch 17, and the coloring data is outputted to the first coloring circuit 20. The address of font data in the data stored in the second RAM 27 is outputted to the switch 17, and the coloring data is outputted to the second coloring circuit 21.

Numeral 25 designates a timing circuit to which, though omitted in the figure, a horizontal synchronizing signal, a vertical synchronizing signal and clock signal for character display are inputted, and according to these signals, a timing signal for operating the screen display circuit of the present invention is generated in the same way as in the timing circuit 14 of the aforementioned first embodiment. However, the timing signal generated by the timing circuit 25 of the second embodiment is given to the first register 23, second register 24, first RAM 26, second RAM 27, switch 17, first shift register 18 and second shift register 19.

The other configuration is same as that of the aforementioned first embodiment.

The operation of the second embodiment of the screen display circuit of the present invention having such configuration is as follows.

When the CPU 1 outputs the address of font data and its coloring data of the character to be displayed in the block of the first layer L1, the first register 23 stores the block number and the first RAM 26 stores the address of font data and its coloring data. When the CPU 1 outputs the address of font data and its coloring data of the character to be displayed in the block of the second layer L2, the second register 24 stores the block number and the second RAM 27 stores the address of font data and its coloring data.

Next, by controlling of the timing circuit 25, the first RAM 26 outputs data at the timing corresponding to the block number to be displayed on the first layer L1 given from the first shift register 23, and the second RAM 27 outputs data at the timing corresponding to the block number to be displayed on the second layer L2 given from the second shift register 24. Thereby, from the first RAM 26, the address of font data of the character to be displayed on the first layer L1 is given to the switch 17, and the coloring data is given to the first coloring circuit 20. From the second RAM 27, the address of font data of the character to be displayed on the second layer L2 is given to the switch 17, and the coloring data is given to the second coloring circuit 21.

Then, by controlling the switch 17 so as to connect to the first RAM 26 at first and giving the address of font data outputted by the first RAM 26 to the ROM 5, the timing circuit 25 outputs the corresponding font data from the ROM 5 in the form of parallel data. The data outputted from the ROM 5 is inputted to the first shift register 18 by controlling of the timing circuit 25.

Next, by controlling the switch 17 so as to connect to the second RAM 27 at first and giving the font data address outputted by the second RAM 27 to the ROM 5, the timing circuit 25 makes the corresponding font data outputted from the ROM 5 in the form of parallel data. The data outputted from the ROM 5 is inputted to the second shift register 19 by controlling of the timing circuit 25.

The further operation is same as that in the aforementioned first embodiment.

In such second embodiment of the screen display circuit of the present invention, though only one ROM is enough, the two RAMs are necessary. However, in the aforementioned first embodiment, though a double access speed is required for both the ROM and RAM as compared with the conventional circuit, in the second embodiment, a double access speed is required only for the ROM. Thus, the hardware quantity is not required to be increased so much as compared with the first embodiment as a whole, because the RAM having a relatively slow access time can be used and the timing circuit can be constructed relatively simply.

[Third Embodiment]

Figure 6:
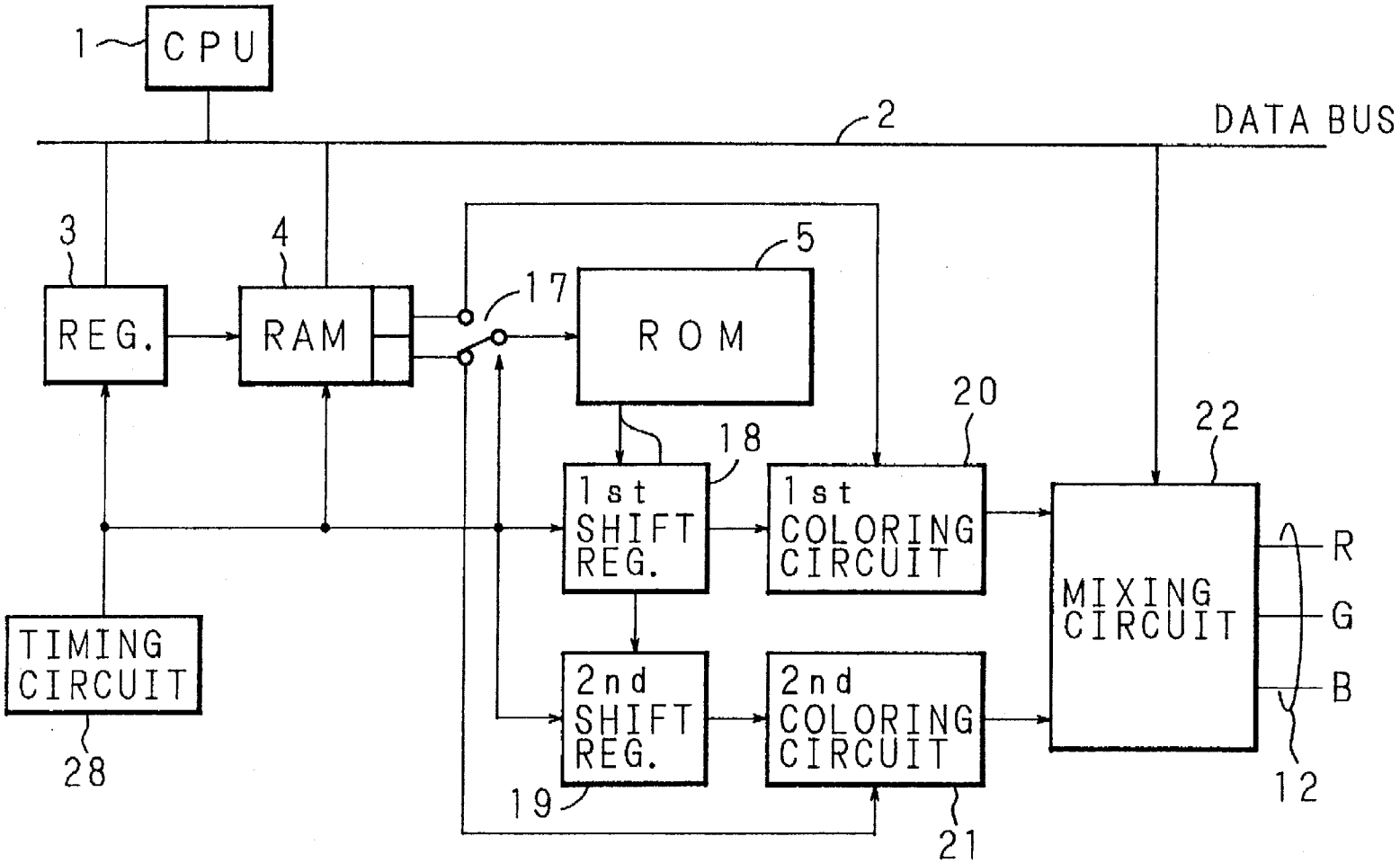
FIG. 6 is a block diagram showing a configuration example of a third embodiment of a screen display circuit according to the present invention.

Next, a third embodiment of the screen display circuit of the present invention is described with reference to a block diagram of FIG. 6 showing its configuration. In the third embodiment, it is not an object to accomplish 2-group character display of the character display function peculiar to the image display apparatus and the function of displaying character codes sent from the broadcasting station as intended in the first and second embodiments, but it is an object to realize the function of displaying the character not having the font data in the ROM. And hence, the difference between the third embodiment shown in the block diagram of FIG. 6 and the aforementioned first embodiment is that, the configuration of the RAM 4 is a little different from the RAM 4 designated by numeral 4 in the first embodiment, and the first and second buffers 15 and 16 provided in the first embodiment are not provided in the third embodiment.

Figure 7:
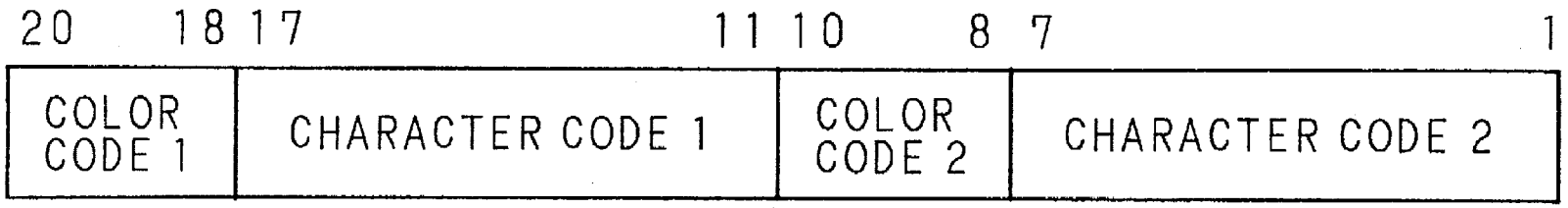
FIG. 7 is a schematic diagram showing the setting of a bit field of data stored in a RAM for designating characters in a third embodiment of a screen display circuit of the present invention.

In the third embodiment, a bit field as shown in a schematic diagram of FIG. 7 is set in data stored in the RAM 4 for designating the character. That is, in the 20-bit data, a color code 1 is allocated to the bits 20 through 18, a character code 1 is allocated to the bits 17 through 11, a color code 2 is allocated to the bits 10 through 8 and a character code 2 is allocated to the bits 7 through 1.

The color code 1 is coloring information of a first font, the character code 1 is a portion of storage address in the ROM 5 of the first font, the color code 2 is coloring information of a second font and the character code 2 is a portion of storage address in the ROM 5 of the second font.

From the RAM 4, at the timing corresponding to the character display position given from the register 3, the bits 20 through 11 among the 20-bit data as shown in FIG. 7 are given to the switch 17 and first coloring circuit 20, more specifically, the data of color code 1 of the bits 20 through 18 is given to the first coloring circuit 20, and the data of character code 1 of the bits 17 through 11 is given to the ROM 5 via the switch 17. Also, the bits 10 through 1 in the 20-bit data are given to the switch 17 and second coloring circuit 21, more specifically, the data of color code 2 of the bits 10 through 8 is given to the second coloring circuit 21, and the data of character code 2 of the bits 7 through 1 is given to the ROM 5 via the switch 17.

Figure 8:
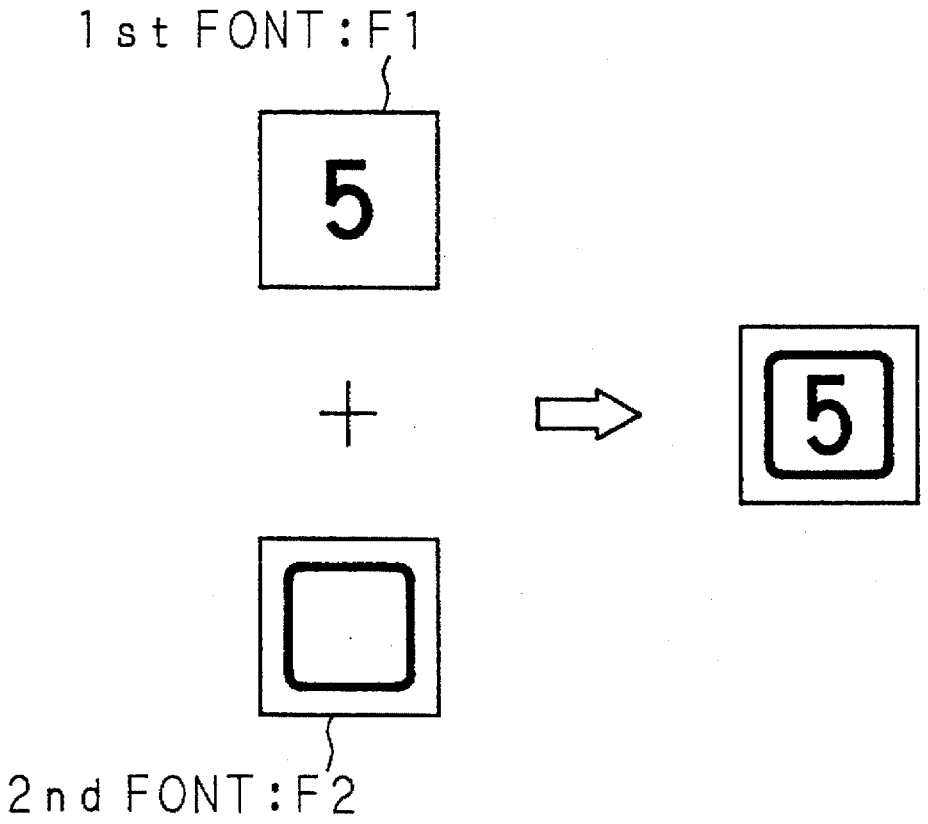
FIG. 8 is a schematic diagram showing an example of displaying state performed by a third embodiment of a screen display circuit of the present invention.

The further operation is same as that in the first embodiment. In such a third embodiment, for example, as shown in a schematic diagram of FIG. 8, when it is assumed that "5" is designated as the character code of the first font F1 by the bits 17 through 11 of the 20-bit data, and "□" is designated as the character code of the second font F2 by the bits 7 through 1, a pattern of the character "5" surrounded by "□" is displayed on a display screen. Thus, even when the font data is not prepared in the ROM 5 for a pattern, by giving data as shown in FIG. 7 to the RAM 4 from the CPU 1 and combining it with the font data prepared in the ROM 5 beforehand, various patterns can be displayed.

When the RAM 4 shown as one RAM in the circuit of the third embodiment is so constituted as to store each 10 bits of the 20-bit data shown in FIG. 7, by utilizing two RAMs 26 and 27 in the circuit of the second embodiment shown in FIG. 5, the circuits of the second embodiment and the third embodiment can be used commonly.

[Fourth Embodiment]

Figure 9:
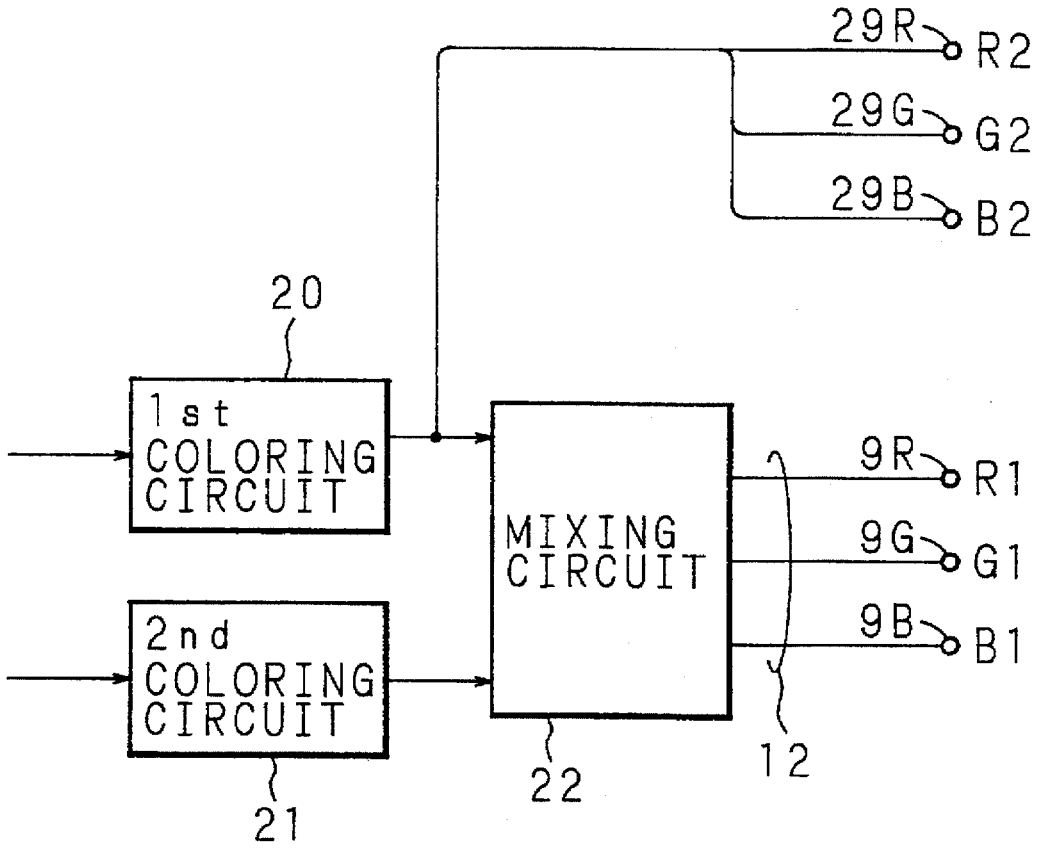
FIG. 9 is a circuit diagram showing a configuration example of a fourth embodiment of a screen display circuit according to the present invention.

Next, a fourth embodiment of the screen display circuit of the present invention is described. In the fourth embodiment, as a circuit configuration shown in FIG. 9, it is so constituted that, one set of the R, G and B signals outputted to a mixing circuit 22 from a first coloring circuit 20 or a second coloring circuit 21 can be outputted from output terminals 29R, 29G and 29B besides output terminals 9R, 9G and 9B from the mixing circuit 22.

In such fourth embodiment, when two sets of display apparatus such as a CRT display are prepared, it is possible to display the R, G and B signals outputted from the output terminals 9R, 9G and 9B separately from the R, G and B, signals outputted from the output terminals 29R, 29G and 29B.

[Fifth Embodiment]

Figure 10:
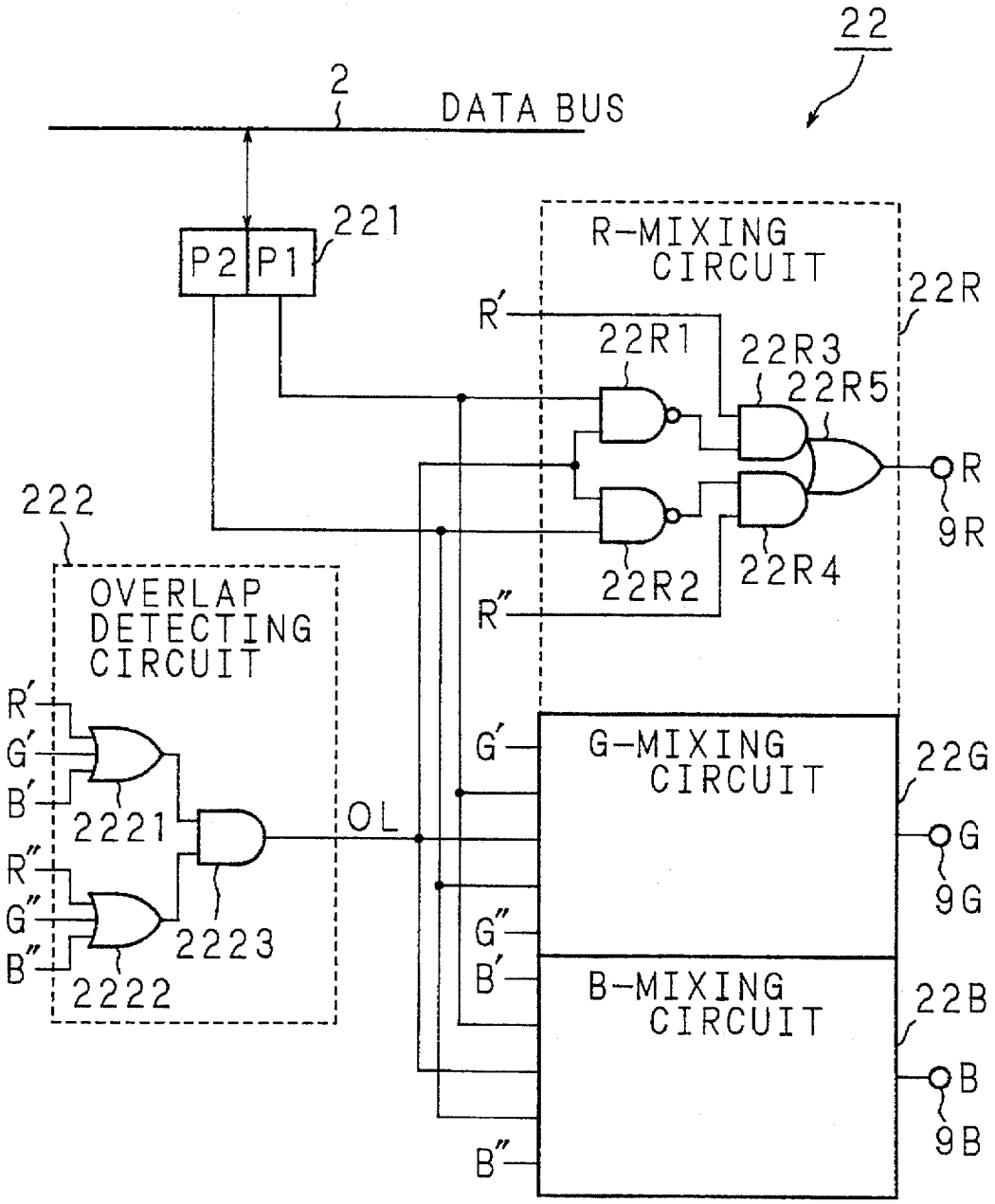
FIG. 10 is a circuit diagram showing a configuration example of a mixing circuit used in a first to third embodiments of a screen display circuit of the present invention.

Next, a configuration of the mixing circuit 22 used in the first through third embodiments of the screen display circuit of the present invention is described with reference to a circuit diagram of FIG. 10 showing its configuration example. In the following description on FIG. 10, the R, G and B signals outputted from the first coloring circuit 20 are respectively designated as R', G' and B' signals, and the R, G and B signals outputted from the second coloring circuit 21 are respectively designated as R", G" and B" signals.

In FIG. 10, numeral 221 designates a 2-bit register, which holds 2-bit data given from the CPU 1 via a data bus 2. The 2-bit data (P2 and P1) instruct to OR compose the R, G and B signals outputted from the coloring circuits 20 and 21, or instruct to compose either of the signals according to the priority.

Numeral 222 designates an overlap detecting circuit, which detects a state in which the R, G and B signals are outputted from both the coloring circuits 20 and 21 as a overlapping state, and generates a significant ("1") overlap signal OL. Specifically, the overlap detecting circuit 222 is composed of a 3-input OR gate 2221 inputting the R, G and B signals outputted from the first coloring circuit 20, a 3-input OR gate 2222 inputting the R, G and B signals outputted from the second coloring circuit 21 and a 2-input AND gate 2223 inputting output signal of both the OR gates 2221 and 2222.

When even one signal of the R, G and B signals outputted from the first coloring circuit 20 is significant ("1"), in other words, when dot data is outputted from the first coloring circuit 20, the output signal of the OR gate 2221 becomes "1". Similarly, when even one signal of the R, G and B signals outputted from the second coloring circuit 21 is significant ("1"), in other words, when the dot data is outputted from the second coloring circuit 21, the output signal of the OR gate 2222 becomes "1". Thus, an output of the AND gate 2223, to which the output signals of the OR gates 2221 and 2222 are inputted, becomes "1" when the R, G and B signals are outputted both from the coloring circuits 20 and 21. Thus, the AND gate 2223 detects this state as the overlapping state and generates the significant ("1") overlap signal OL.

Numerals 22R, 22G and 22B respectively designate a mixing circuit for R signal (hereinafter, referred to as an R-mixing circuit), a mixing circuit for G signal (hereinafter, referred to as a G-mixing circuit) and a mixing circuit for B signal (hereinafter, referred to as a B-mixing circuit). Since their circuit configurations are identical, hereupon, only the configuration of the R-mixing circuit 22R is described.

The R-mixing circuit 22R is provided with 2-input NAND gates 22R1 and 22R2, 2-input AND gates 22R3 and 22R4 and a 2-input OR gate 22R5, and the R' signal outputted from the first coloring circuit 20, the R" signal outputted from the second coloring circuit 21, bits P2 and P1 of the 2-bit register 221 and the overlap signal OL which is the output signal of the overlap detecting circuit 222 are inputted thereto.

Specifically, the bit P1 of the 2-bit register 221 and the overlap signal OL are inputted to the 2-input NAND gate 22R1, and the overlap signal OL and the bit P2 of the 2-bit register 221 are inputted to the 2-input NAND gate 22R2. An output signal of the NAND gate 22R1 and the R' signal which is the output signal of the first coloring circuit 20 are inputted to the 2-input AND gate 22R3, and an output signal of the NAND gate 22R2 and the R" signal which is the output signal of the second coloring circuit 21 are inputted to the 2-input AND gate 22R4. Output signals of the AND gates 22R3 and 22R4 are inputted to the 2-input OR gate 22R5.

FIG. 11 is a table showing values of the data (P2 and P1) set in the 2-bit register 221 from the CPU 1 and the state of output signals of the mixing circuit 22. When the 2-bit data (P1 and P2) are "00", the R, G and B signals from the coloring circuits 20 and 21 are OR composed, when "10", the R', G' and B' signals from the first coloring circuit 20 have priority and when "01", the R", G" and B" signals from the second coloring circuit 21 have priority.

In the following, the operation of the mixing circuit 22 of the screen display circuit of the present invention is specifically described.

When the R, G and B, signals are outputted only from either of the first coloring circuit 20 or the second coloring circuit 21, the overlap signal OL becomes insignificant ("0"), or the non-overlapping state is detected. In this case, the output signals of the NAND gates 22R1 and 22R2 become "1" regardless of the data set in the 2-bit register 221. Thus, when the R', G' and B' signals are outputted from the first coloring circuit 20, in the R-mixing circuit 22R, the R' signal is outputted intact from the OR gate 22R5 via the AND gate 22R3, and becomes an output signal of the output terminal 9R. Similarly, in the B-mixing circuit 22B, the B' signal is outputted intact and becomes an output signal of the output terminal 9B, and in the G-mixing circuit 22G, the G' signal is outputted intact and becomes an output signal of the output terminal 9G. Also, when the R", G" and B" signals are outputted from the second coloring circuit 21, in the R-mixing circuit 22R, the signal R" is outputted intact from the OR gate 22R5 via the AND gate 22R4 and becomes the output signal of the output terminal 9R. Similarly, in the B-mixing circuit 22B, the signal B" is outputted intact and becomes the output signal of the output terminal 9B, and in the G-mixing circuit 22G, the signal G" is outputted intact and becomes the output signal of the output terminal 9G.

On the contrary, when the R, G and B signals are outputted from the first coloring circuit 20 and the second coloring circuit 21, the overlap signal OL becomes significant ("1"), or the overlapping state is detected. In this case, the R, G and B signals are composed according to the data set in the 2-bit register 221.

When "00" is set as the 2-bit data (P2 and P1) in the 2-bit register 221, as shown in FIG. 11, both the R, G and B signals are OR composed. Specifically, it becomes as follows. Since "00" is set as the 2-bit data (P2 and P1) and the overlap signal OL is "1", both the output signals of the NAND gates 22R1 and 22R2 become "1". And hence, the AND gate 22R3 becomes a state of outputting the R' signal from the first coloring circuit 20, which is the other input signal, intact, and the AND gate 22R4 becomes a state of outputting the R" signal from the second coloring circuit 21, which is the other input signal, intact.

Since the output signals of both the AND gates 22R3 and 22R4 are inputted to the OR gate 22R5, the output signal of the OR gate 22R5 becomes an OR composed signal of the R' signal and R" signal. Such an operation is same in the B-mixing circuit 22B and G-mixing circuit 22G. Thus, mixing circuit 22 outputs the R, G and B signals obtained by OR composing the R', G' and B' signals from the first coloring circuit 20 and R", G" and B" signals from the second coloring circuit 21.

When "10" is set as 2-bit data (P2 and P1) in the 2-bit register 221, as shown in FIG. 11, the R', G' and B' signals outputted from the first coloring circuit 20 have priority. Specifically, it becomes as follows. Since "10" is set as the 2-bit data (P2 and P1) and the overlap signal OL is "1", the output signal of the NAND gate 22R1 becomes "1" and the output signal of the NAND gate 22R2 becomes "0". And hence, though the AND gate 22R3 becomes a state of outputting the R' signal from the first coloring circuit 20, which is the other input signal, intact, the AND gate 22R4 becomes a state of outputting "0" regardless of the R" signal from the second coloring circuit 21, which is the other input signal.

Since the output signals of both the AND gates 22R3 and 22R4 are inputted to the OR gate 22R5, the output signal of the OR gate 22R5 becomes a state of outputting only the R' signal intact, or in a state of giving priority to the R' signal from the first coloring circuit 20. Such an operation is same in the B-mixing circuit 22B and G-mixing circuit 22G. Thus, the mixing circuit 22 becomes a state of outputting the R', G' and B' signals from the first coloring circuit 20 according to priority.

When "01" is set as the 2-bit data (P2 and P1) in the 2-bit register 221, as shown in FIG. 11, the R", G" and B" signals outputted from the second coloring circuit 21 have priority. Specifically, it becomes as follows. Since "01" is set as the 2-bit data (P2 and P1) and the overlap signal OL is "1", the output signal of the NAND gate 22R1 becomes "0" and the output signal of the NAND gate 22R2 becomes "1". And hence, the AND gate 22R3 becomes a state of outputting "0" regardless of the R' signal from the first coloring circuit 20, which is the other input signal, and the AND gate 22R4 becomes a state of outputting the R" signal from the second coloring circuit 21, which is the other input signal, intact.

Since the output signals of both the AND gates 22R3 and 22R4 are inputted to the OR gate 22R5, the output signal of the OR gate 22R5 becomes a state of outputting only the R" signal intact, or a state of giving priority to the R" signal from the second coloring circuit 21. Such an operation is same in the B-mixing circuit 22B and G-mixing circuit 22G. Thus, the mixing circuit 22 becomes a state of outputting the R", G" and B" signals from the second coloring circuit 21 according to priority.

Figure 1B:
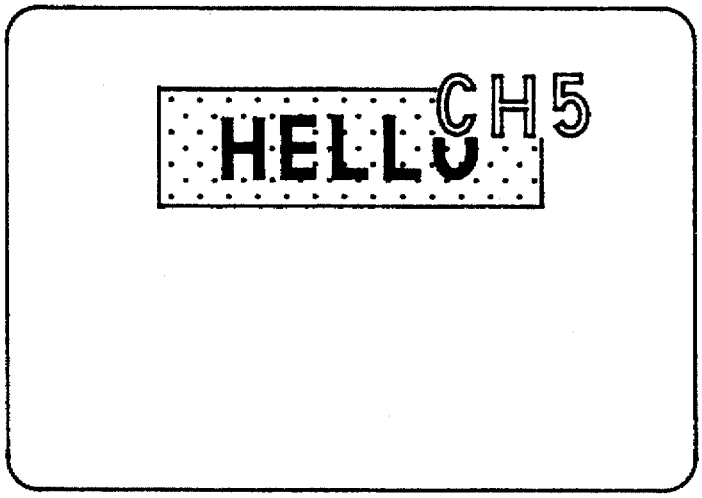
Figure 2:
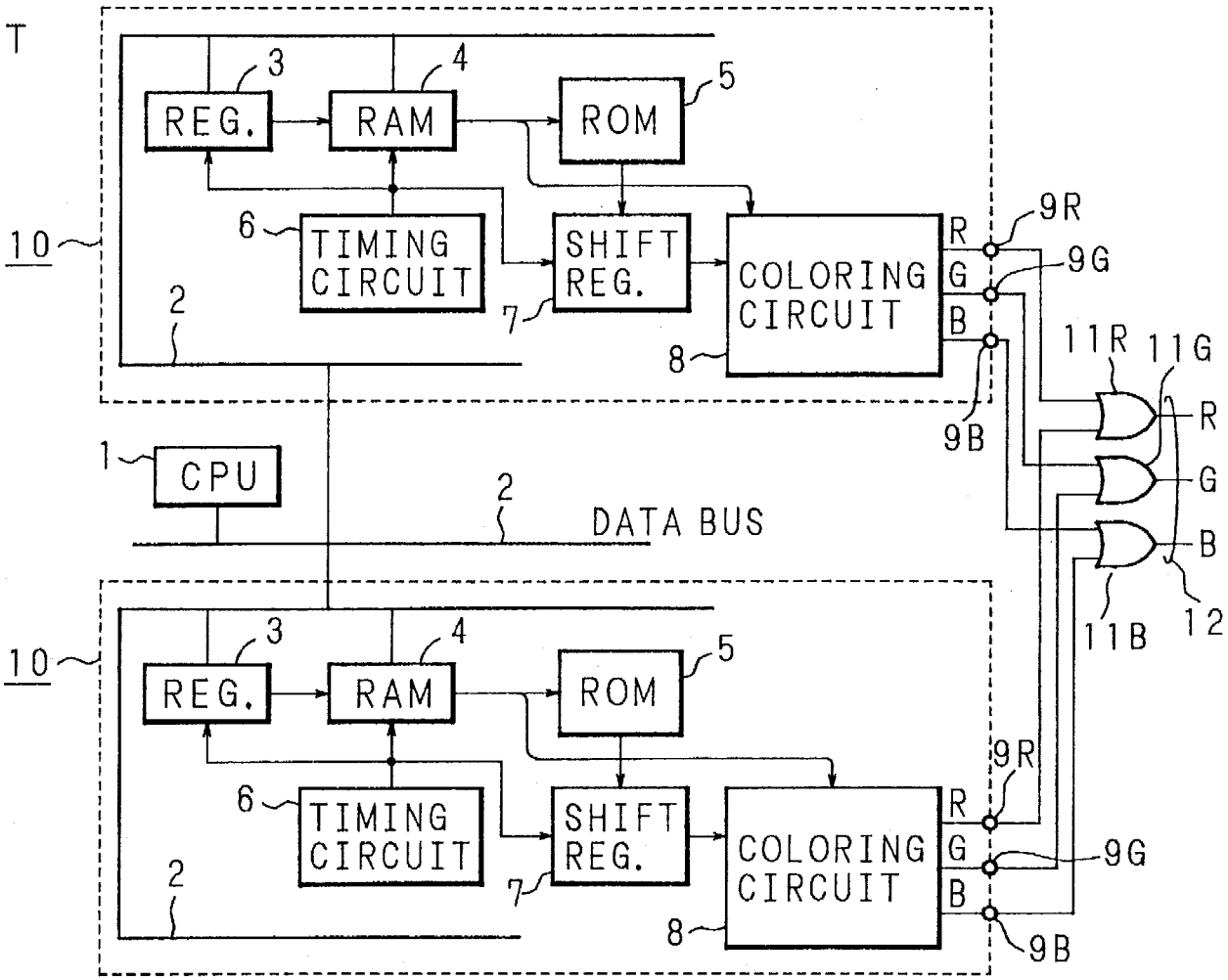
FIG. 2 PRIOR ART
FIG. 2 is a block diagram showing a configuration example of a conventional screen display circuit.

When the R, G and B signals outputted from both the coloring circuits 20 and 21 are OR composed by the mixing circuit 22 of the screen display circuit of the present invention, in the same way as in the conventional example, display as shown in the schematic diagram of FIG. 1A is performed. However, on the other hand, for example, when a font of the channel number "CH5" is displayed according to priority, as is shown in the schematic diagram of FIG. 1B, only font data of "CH5" is displayed for the overlapping portion.

As particularly described heretofore, according to the screen display circuit of the present invention, since two sets of screen display circuits required in the past, one for the character display function peculiar to the image display apparatus, and another one for displaying characters, symbols and the like designated by the character code signals sent from the broadcasting station, were replaced by one set of screen display circuit, particularly, by adopting the configuration where only one ROM storing the font data is used, hardwares can be reduced and the manufacturing cost can be reduced.

Also, according to the screen display circuit of the present invention, since it is so constituted that the character not having the font data beforehand can be displayed by composing the two screens, a quantity of the ROM storing the font data can be reduced, or conversely, the characters which can be displayed by the same ROM capacity can be increased. Such configuration can be utilized in the case of displaying, for example, voiced sound symbols, semivoiced sound symbols and the like of Japanese characters.

Furthermore, according to the screen display circuit of the present invention, when a plurality of display apparatus are provided, it is possible to display the characters on the display apparatus other than the main display apparatus.

Meanwhile, according to the screen display circuit of the present invention, it is possible to OR compose the characters displayed on a plurality of screens, or compose any of the screens according to the priorities.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalents of such meets and bounds thereof are therefore intended to be embraced by the claims.

What is claimed is:

1. A screen display circuit which composes a first screen and a second screen whereon dot patterns are displayed respectively, and displays the composed screen on a display apparatus, comprising:

a display position register configured to store data designating either the first screen or the second screen whereon the pattern to be displayed is displayed, and data designating the position of the pattern to be displayed on the designated screen;

a display pattern memory configured to store data designating the patterns to be displayed;

a first buffer configured to temporarily store and output the data designating the pattern to be displayed on the first screen among the data stored in said display pattern memory;

a second buffer configured to temporarily store and output the data designating the pattern to be displayed on the second screen among the data stored in said display pattern storing means;

a dot data memory configured to store dot data of a plurality of patterns, and output the corresponding dot data when the data designating the pattern is given;

switching means for connecting said dot data memory alternately to said first buffer and said second buffer; and composing means for composing the dot data of the pattern to be displayed on said first screen and the dot data of the pattern to be displayed on said second screen which are outputted from said dot data memory;

wherein said display pattern memory, at the timing of displaying the display position stored in said display position register, outputs the data designating the pattern to be displayed on said first screen and stores it in said first buffer, and outputs the data designating the pattern to be displayed on said second screen and stores it in said second buffer, said switching means gives the data stored in said first buffer and the data stored in said second buffer alternately to said dot data memory, said dot data memory alternately outputs the dot data of the pattern corresponding to the data given from said first buffer and the dot data of the pattern corresponding to the data given from said second buffer, and said composing means composes the dot data outputted alternately from said dot data memory.

2. The screen display circuit as set forth in claim 1, wherein said composing means includes, logical-summing means for obtaining the logical sum of data outputted alternately from dot data memory, selective outputting means for selectively outputting either of the two, and controlling means for functioning either said logical-summing means or said selective outputting means.

3. The screen display circuit as set forth in claim 1, further comprising, means for outputting, by bypassing said composing means, at least one of data outputted alternately from said dot data memory, and inputted to said composing means.

4. A screen display circuit which composes a first screen and a second screen whereon dot patterns are displayed respectively, and displays the composed screen on a display apparatus, comprising:

a first display position register configured to store data designating the position, on the screen, of the pattern to be displayed on said first screen;

a second display position register configured to store data designating the position, on the screen, of the pattern to be displayed on said second screen;

a first display pattern memory configured to store data designating the pattern to be displayed on said first screen;

a second display pattern memory configured to store data designating the pattern to be displayed on said second screen;

a dot data memory configured to store dot data of a plurality of patterns, and output the corresponding dot data when the data designating the pattern is given;

switching means for connecting said dot data memory alternately to said first display pattern memory and said second display pattern memory; and composing means for composing the dot data of the pattern to be displayed on said first screen and the dot data of the pattern to be displayed on said second screen which are outputted from said dot data memory;

wherein said first display pattern memory, at the timing of displaying the display position stored in said first display position register, outputs the data designating the pattern to be displayed on said first screen, said second display pattern memory, at the timing of displaying the display position stored in said second display position register, outputs the data designating the pattern to be displayed on said second screen, said switching means gives the data outputted from said first display pattern register and the data outputted from said second display patterns register alternately to said dot data memory, said dot data memory alternately outputs the dot data of the pattern corresponding to the data given from said first display pattern memory and the dot data of the pattern corresponding to the data given from said second display pattern memory, and said composing means composes the dot data outputted alternately from said dot data memory.

5. The screen display circuit as set forth in claim 4, wherein said composing means includes, logical-summing means for obtaining the logical sum of data outputted alternately from dot data memory, selective outputting means for selectively outputting either of the two, and controlling means for functioning either said logical-summing means or said selective outputting means.

6. The screen display circuit as set forth in claim 4, further comprising, means for outputting, by bypassing said composing means, at least one of data outputted alternately from said dot data memory, and inputted to said composing means.

7. A screen display circuit which composes a first screen and a second screen whereon dot patterns are displayed respectively, and displays the composed screen on a display apparatus, comprising:

a display position register configured to store data designating the common display position, on said first screen and second screen, of the patterns to be displayed;

a display pattern memory configured to store data designating simultaneously, by one data, a first pattern to be displayed on said first screen and a second pattern to be displayed on said second screen;

a dot data memory configured to store dot data of a plurality of patterns, and outputting the corresponding dot data when the data designating the pattern is given;

switching means for giving a portion designating the first pattern and a portion designating the second pattern of the data stored in said display pattern memory alternately to said dot data memory; and composing means for composing the dot data of the pattern to be displayed on said first screen and the dot data of the pattern to be displayed on said second screen which are outputted from said dot data memory;

wherein said display pattern memory, at the timing of displaying the display position stored in said display position register, outputs data designating the pattern to be displayed, said switching means gives a portion designating the first pattern and a portion designating the second pattern among the data outputted from said display pattern memory alternately to said dot data memory, said dot data memory alternately outputs the dot data of the pattern corresponding respectively to the data given alternately from said display pattern memory, and said composing means composes the dot data outputted alternately from said dot data memory.

8. The screen display circuit as set forth in claim 7, wherein said composing means includes, logical-summing means for obtaining the logical sum of data outputted alternately from dot data memory, selective outputting means for selectively outputting either of the two, and controlling means for functioning either said logical-summing means or said selective outputting means.

9. The screen display circuit as set forth in claim 7, further comprising, means for outputting, by bypassing said composing means, at least one of data outputted alternately from said dot data memory, and inputted to said composing means.

10. A screen display circuit which composes first to n-th screens (n indicates natural numbers not less than 2) whereon dot patterns are displayed respectively, and displays the composed screen on a display apparatus, comprising:

a display position register configured to store data designating any of said first to n-th screens whereon the pattern to be displayed is displayed, and data designating the position of the pattern to be displayed ont he designated screen;

a display pattern memory configured to store data designating the patterns to be displayed;

first to n-th buffers configured to temporarily store and output data designating the pattern to be displayed respectively on said first to n-th screens among the data stored in said display pattern memory;

a dot data memory configured to store dot data of a plurality of patterns, and outputting the corresponding dot data when the data designating the pattern is given;

switching means for connecting said dot data memory successively to said first to n-th buffers; and composing means for composing dot data of the patterns to be displayed respectively on said first to n-th screens outputted from said dot data memory;

wherein said display pattern memory, at the timing of displaying the display position stored in said display position register, outputs the data designating the pattern to be displayed on said first to n-th screens, and stores the data respectively in said first to n-th buffers, said switching means gives the data stored in said first to n-th buffers successively to said dot data memory, said dot data memory successively outputs dot data of the patterns corresponding to the data given successively from said first to n-th buffers, and said composing means composes the dot data outputted successively from said dot data memory.

11. The screen display circuit as set forth in claim 10, wherein said composing means includes, logical-summing means for obtaining the logical sum of data outputted successively from dot data memory, selective outputting means for selectively outputting either of the two, and controlling means for functioning either said logical-summing means or said selective outputting means.

12. The screen display circuit as set forth in claim 10, further comprising, means for outputting, by bypassing said composing means, at least one of data outputted successively from said dot data memory, and inputted to said composing means.

13. A screen display circuit which composes first to n-th screens (n indicates natural numbers not less than 2) whereon dot patterns are respectively displayed, and displays the composed screen on a display apparatus, comprising:

first to n-th display position registers configured to store data designating the position, on the screen, of the patterns to be displayed respectively on said first to n-th screens;

first to n-th display memories configured to store data designating the patterns to be displayed respectively on said first to n-th screens;

a dot data memory configured to store dot data of a plurality of patterns, and output the corresponding dot data when the data designating the pattern is given;

switching means for connecting said dot data memory successively to said first to n-th display pattern memory; and composing means for composing dot data of the patterns to be displayed respectively on said first to n-th screens outputted from said dot data memory;

wherein said first to n-th display pattern memory, at the timing of displaying the display position stored in said display position registers, respectively output data designating the patterns to be displayed respectively on said first to n-th screens, said switching means gives data outputted respectively from said first to n-th display pattern memory successively to said dot data memory, said dot data memory successively outputs dot data of the pattern corresponding to the data given respectively from said first to n-th display pattern memory, and said composing means composes the dot data outputted successively from said dot data memory.

14. The screen display circuit as set forth in claim 13, wherein said composing means includes, logical-summing means for obtaining the logical sum of data outputted successively from dot data memory, selective outputting means for selectively outputting either of the two, and controlling means for functioning either said logical-summing means or said selective outputting means.

15. The screen display circuit as set forth in claim 13, further comprising, means for outputting, by bypassing said composing means, at least one of data outputted successively from said dot data memory, and inputted to said composing means.

16. A screen display circuit which composes first to n-th screens (n indicates natural numbers not less than 2) whereon dot patterns are respectively displayed, and displays the composed screen on a display apparatus, comprising:

a display position register configured to store data designating the common display position, on said first to n-th screens, of the pattern to be displayed;

a display pattern memory configured to store data designating simultaneously, by one data, the patterns to be displayed respectively on said first to n-th screens;

a dot data memory configured to store dot data of a plurality of patterns, and outputting the corresponding dot data when the data designating the pattern is given;

switching means for giving portions respectively designating first to n-th patterns of data stored in said display pattern memory successively to said dot data memory; and composing means for composing dot data of the patterns to be displayed respectively on said first to n-th screens outputted from said dot data memory;

wherein said display pattern memory, at the timing of displaying the display position stored in said display position register, outputs data designating the pattern to be displayed, said switching means gives portions respectively designating first to n-th patterns of the data outputted from said display pattern memory successively to said dot data memory, said dot data memory successively outputs dot data of the patterns corresponding respectively to the data give successively from said display pattern memory, and said composing means composes the dot data outputted successively from said dot data memory.

17. The screen display circuit as set forth in claim 16, wherein said composing means includes, logical-summing means for obtaining the logical sum of data outputted successively from dot data memory, selective outputting means for selectively outputting either of the two, and controlling means for functioning either said logical-summing means or said selective outputting means.

18. The screen display circuit as set forth in claim 16, further comprising, means for outputting, by bypassing said composing means, at least one of data outputted successively from said dot data memory, and inputted to said composing means.

* * * * *